US006901970B2

(12) United States Patent
Kikuchi

(10) Patent No.: US 6,901,970 B2
(45) Date of Patent: Jun. 7, 2005

(54) AUTOMATIC HEDDLING APPARATUS AND METHOD FOR AUTOMATICALLY HEDDLING

(75) Inventor: Koichi Kikuchi, Shizuoka (JP)

(73) Assignee: Kikuchi Kogyo Co., Ltd., Shizuoka (JP)

( * ) Notice: Subject to any disclaimer, the term of this patent is extended or adjusted under 35 U.S.C. 154(b) by 318 days.

(21) Appl. No.: 10/202,490

(22) Filed: Jul. 24, 2002

(65) Prior Publication Data

US 2004/0016471 A1 Jan. 29, 2004

(51) Int. Cl.[7] ..... D03C 9/00

(52) U.S. Cl. ..... 139/93; 28/205; 28/206; 28/208

(58) Field of Search ..... 139/93; 28/205, 28/206, 208

(56) References Cited

U.S. PATENT DOCUMENTS

| | | | | | |
|---|---|---|---|---|---|
| 1,395,818 | A | * | 11/1921 | Grupe | 28/205 |
| 3,777,339 | A | * | 12/1973 | Fleischer et al. | 28/206 |
| 4,760,628 | A | * | 8/1988 | Kaufmann et al. | 28/201 |
| 4,891,871 | A | * | 1/1990 | Tachibana et al. | 28/205 |
| 4,916,785 | A | * | 4/1990 | Tachibana et al. | 28/206 |
| 4,989,301 | A | | 2/1991 | Ishii et al. | 28/206 |
| 5,153,972 | A | * | 10/1992 | Fabrizio | 28/206 |
| 5,353,844 | A | * | 10/1994 | Monget et al. | 139/20 |
| 5,394,596 | A | * | 3/1995 | Lindenmuller et al. | 28/208 |
| 6,000,439 | A | * | 12/1999 | Speich | 139/1 R |
| 6,092,560 | A | * | 7/2000 | Burkert | 139/57 |
| 6,554,029 | B1 | * | 4/2003 | Hofstetter et al. | 139/383 AA |
| 6,742,546 | B2 | * | 6/2004 | Debaes et al. | 139/21 |
| 6,769,457 | B2 | * | 8/2004 | Debaes et al. | 139/45 |

FOREIGN PATENT DOCUMENTS

| | | | | |
|---|---|---|---|---|
| DE | 375062 | | 5/1923 | |
| DE | 30 05 071 | | 8/1980 | |
| EP | 115393 | A1 * | 8/1984 | D03D/29/00 |

* cited by examiner

*Primary Examiner*—John J. Calvert
*Assistant Examiner*—Robert H. Muromoto, Jr.
(74) *Attorney, Agent, or Firm*—Greer, Burns & Crain, Ltd.

(57) ABSTRACT

An automatic heddling method and a related automatic heddling apparatus 100, by which a plurality of heddles 2 removed from a plurality of heddle frames 1 are integrally collected in such a manner that flat faces 11 of the heddles 2 may face opposite to each other, then a dummy yarn 4 is inserted simultaneously through heddle eyes provided respectively in the plurality of heddles 2 while they are in a collected state, and then the heddles 2 are individually carried with keeping the contact to the dummy yarn 4, from a collecting position 5 of the heddles 2 to a predetermined individual heddle frame designating means 6.

26 Claims, 8 Drawing Sheets

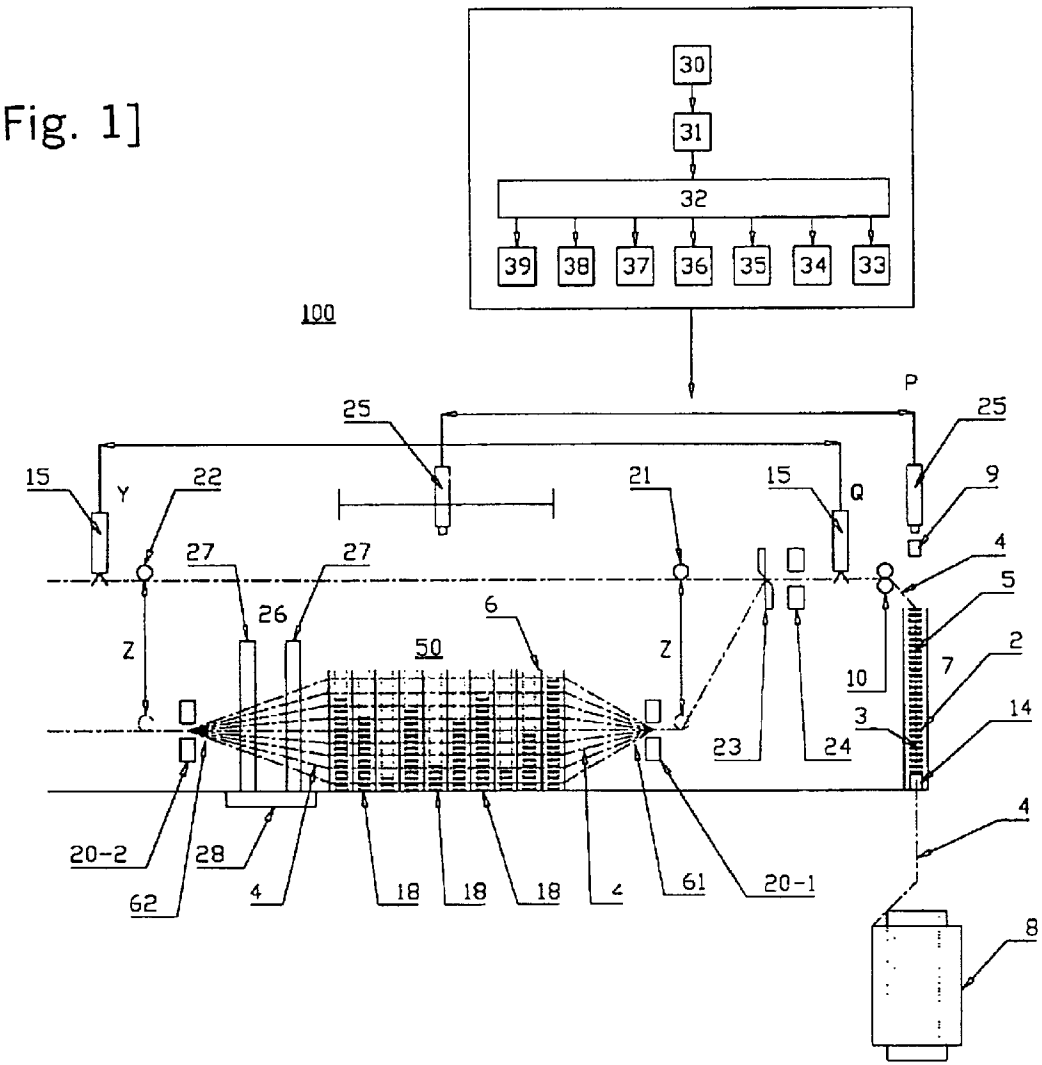
[Fig. 1]

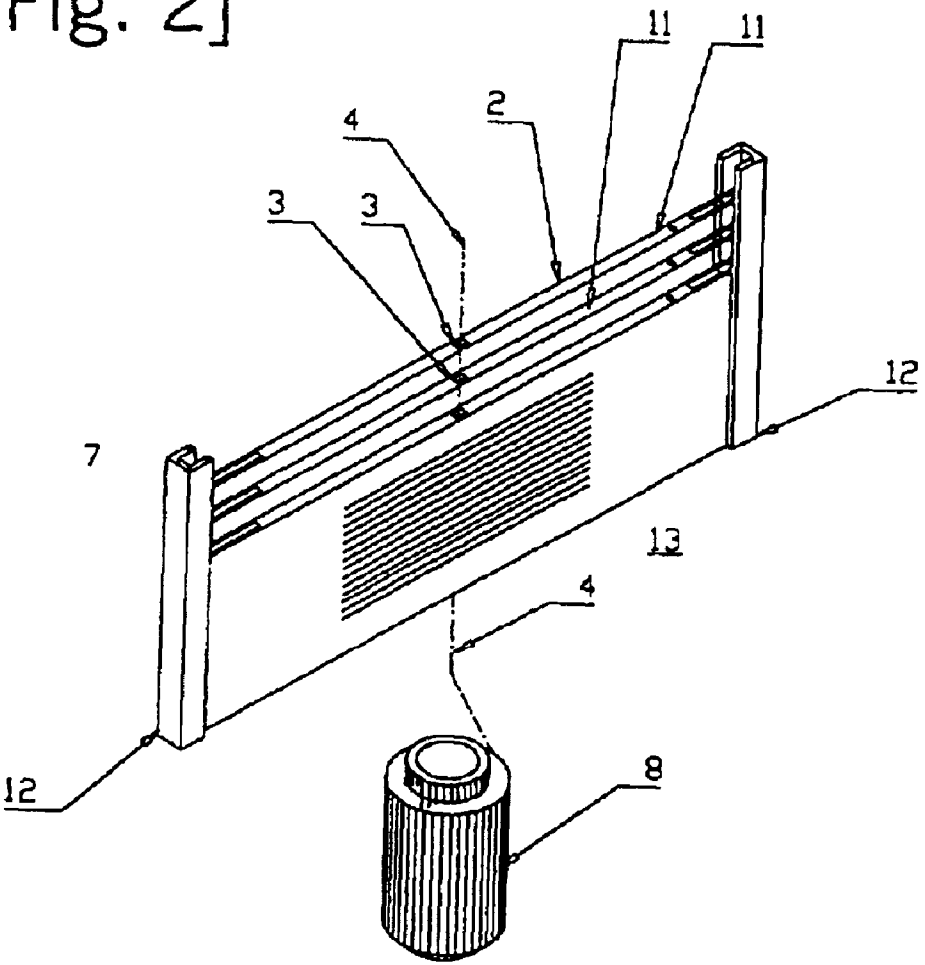
[Fig. 2]

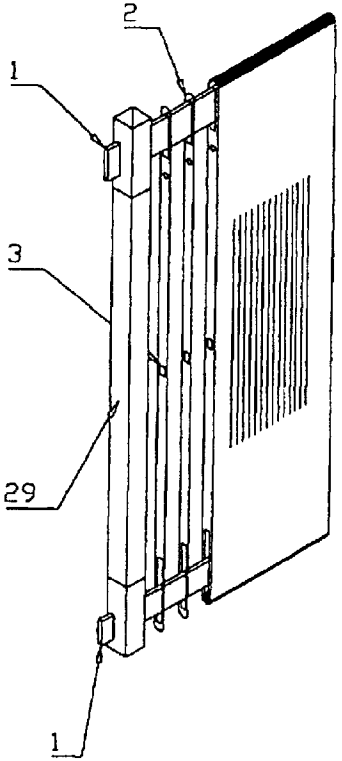
[Fig. 3 A]
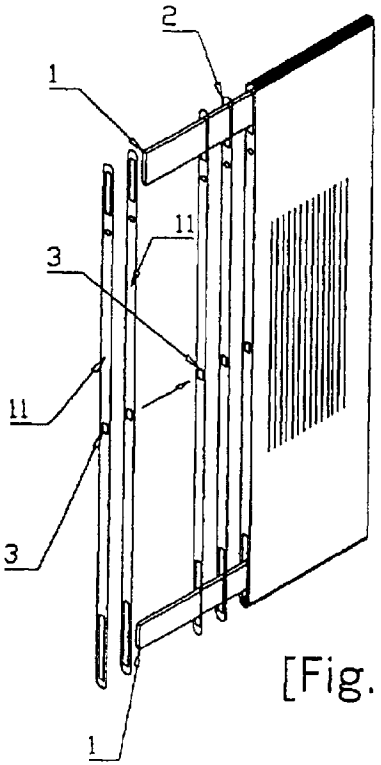
[Fig. 3 B]

[Fig. 4]
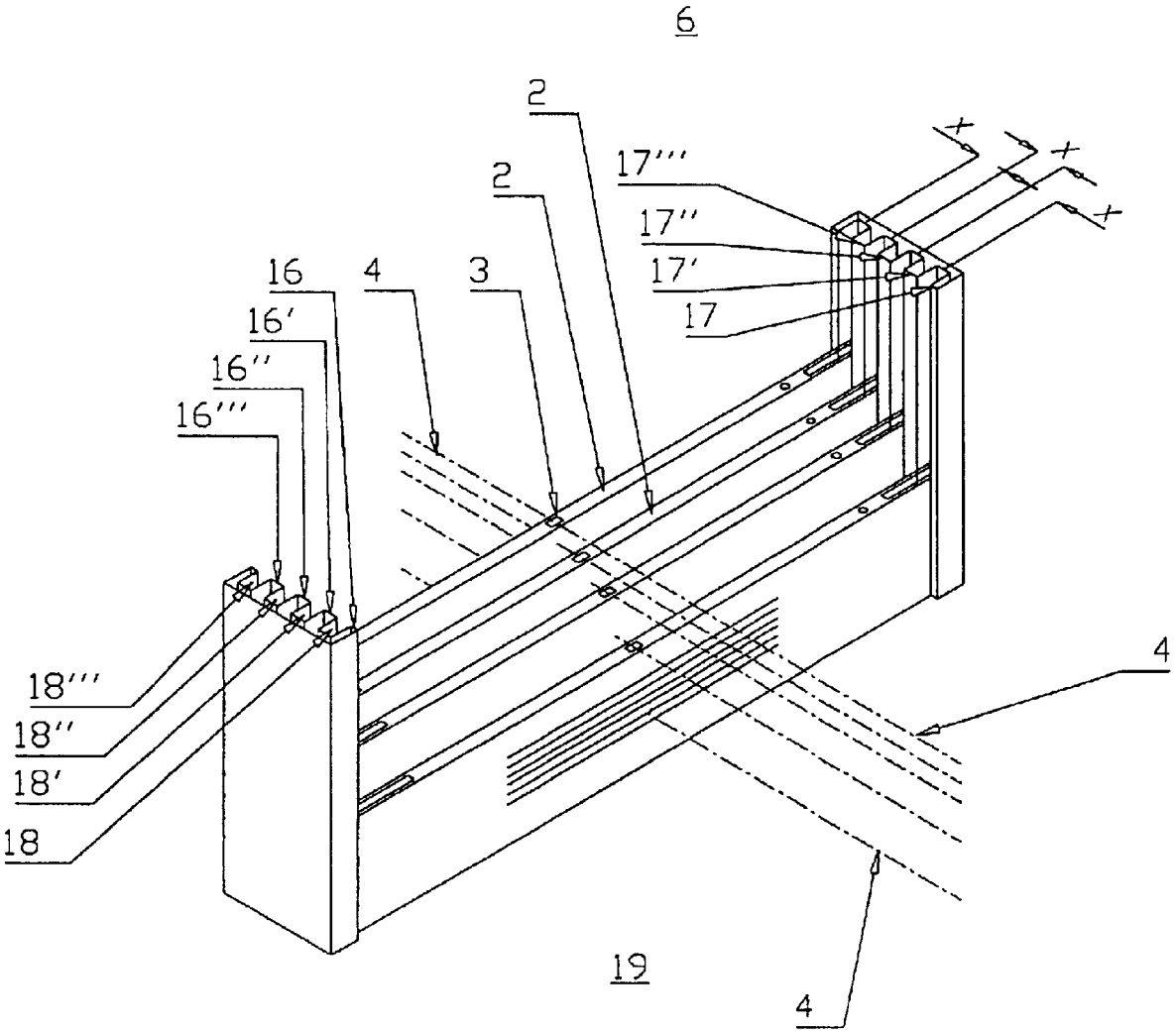

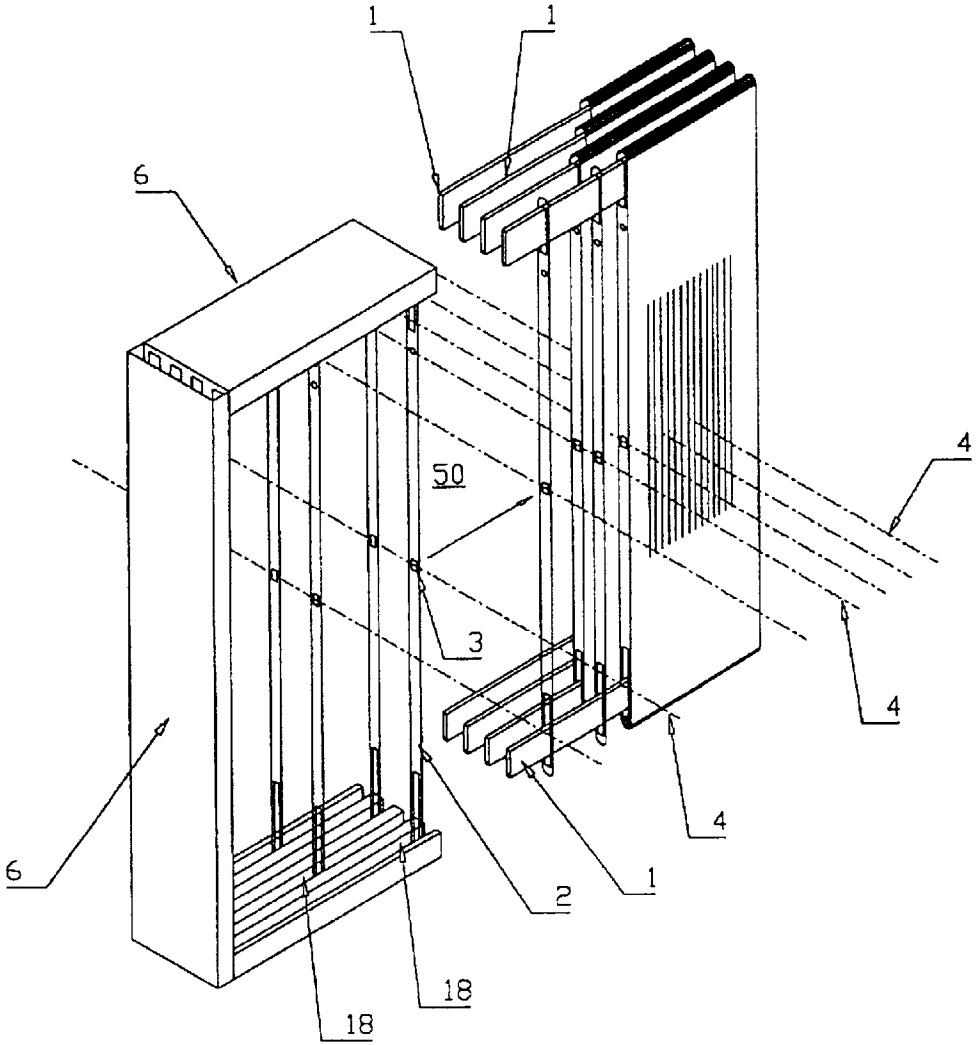
[Fig. 5]

[Fig. 6]
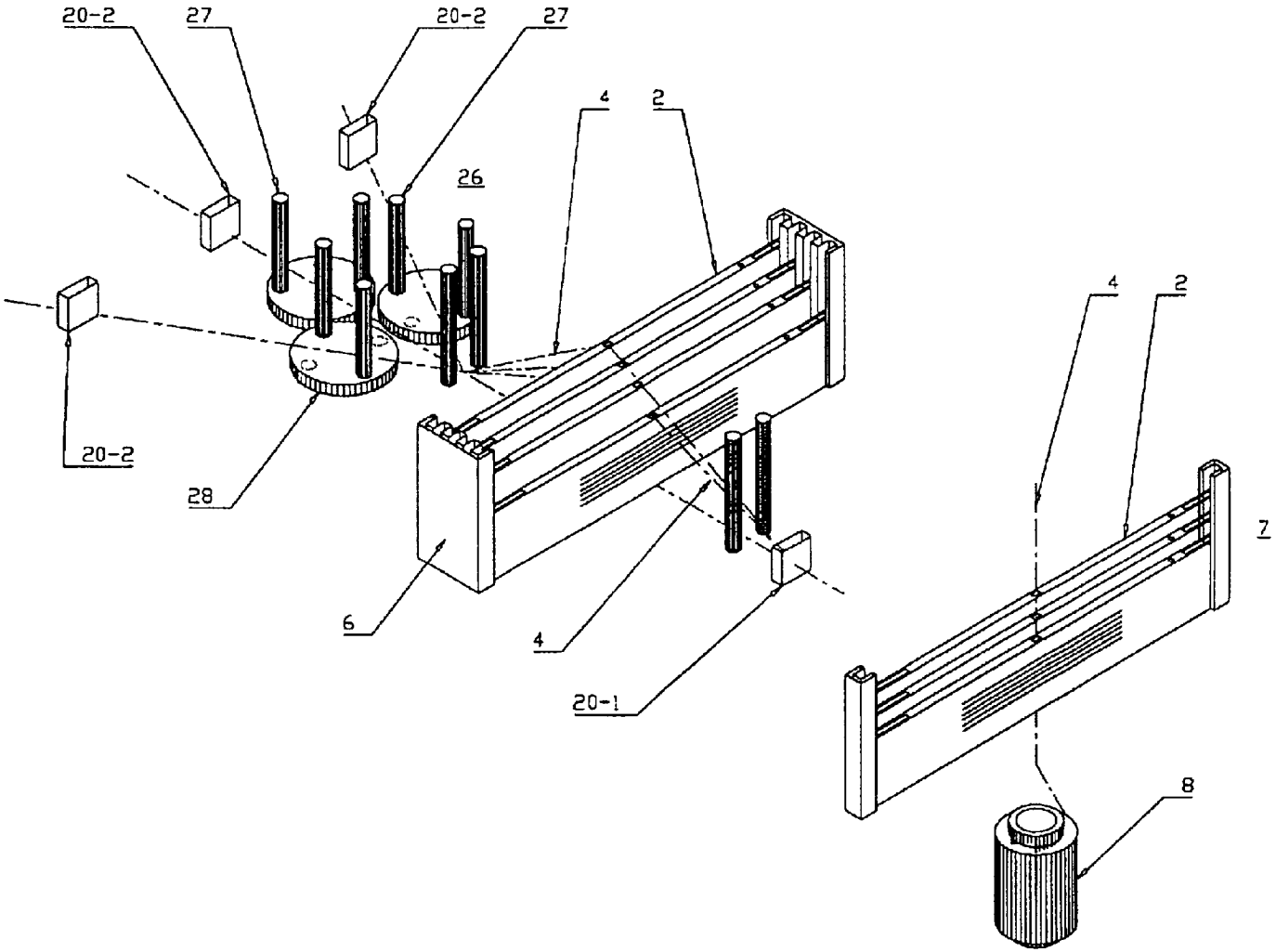

[Fig. 7]
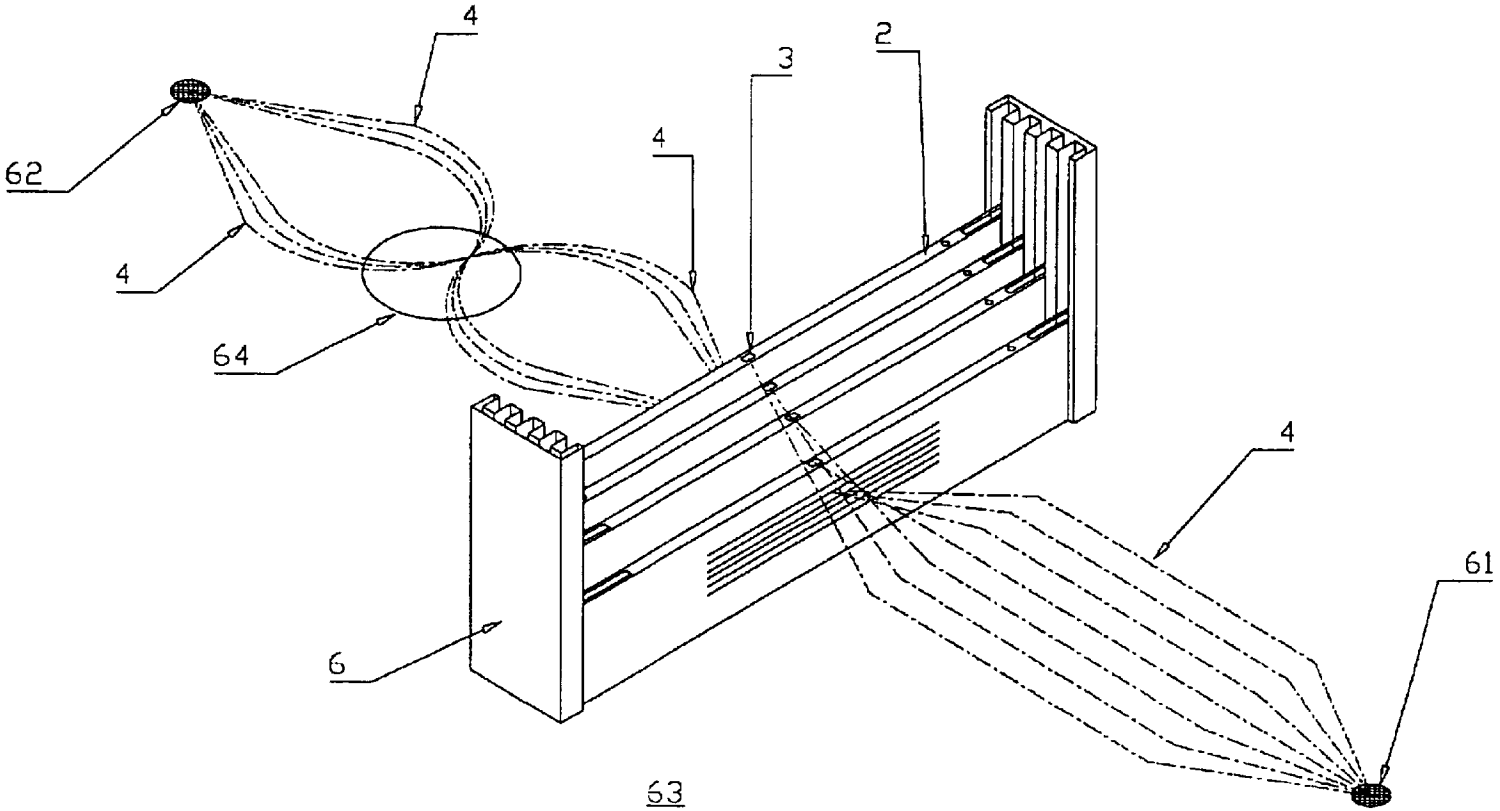

[Fig. 8]
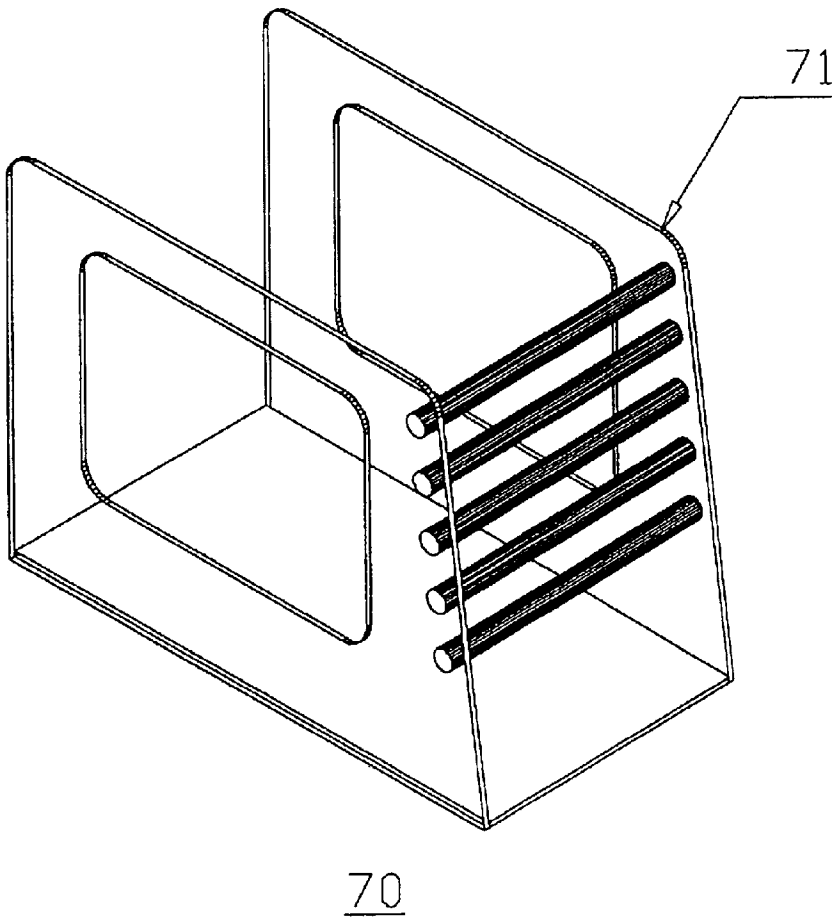

AUTOMATIC HEDDLING APPARATUS AND METHOD FOR AUTOMATICALLY HEDDLING

BACKGROUND OF THE INVENTION

1. Field of the Invention

The present invention relates to an automatic heddling apparatus and more particularly to an automatic heddling apparatus which is used in a fabric producing process in that the warp yarns and weft yarns to be woven are interlaced with each other on an ordinary weaving machine, a narrow fabric weaving machine, a narrow-fabric-dedicated needle weaving machine, etc., and which is used especially in its preparation steps in manufacture of the fabric, which is used for automatically passing warp yarns of a fabric to be woven through a corresponding plurality of heddles provided in each one of predetermined heddle frames, respectively.

2. Description of the Related Art

Conventionally, when a fabric is manufactured typically, warp and weft yarns are interlaced with each other to be woven into a band on a weaving machine, so that it is necessary to pass all of the warp yarns which make up a fabric one by one through heddles specified in a weave construction chart prepared on the basis of a weaving design of a desired fabric, specifically by, for example, using a wire-shaped or narrow thin-sheet-shaped tool having a hook at its tip to manually pass the warp yarns one by one through each yarn passing eye, i.e., heddle eyes of the heddles typically.

To put it in more detail, paired two operators are engaged in warp passing operation as positioned respectively in front of (a side on which the fabric is discharged out) and behind (a side on which the warp yarns are supplied) a heddle-frame mounting section of a weaving machine to which a necessary number of heddle frames to which the heddles are attached, are mounted.

The operator positioned on the front side inserts the above-mentioned tool through the yarn passing eye, i.e., heddle eyes, of the corresponding heddle in a heddle frame specified by the weave construction chart and then stands by.

The other operator positioned on the rear side picks up one warp yarn out of a group of the warp yarns leased beforehand, from an end portion thereof and brings it by his finger tip to the heddle, and engages it at the tip hook of the tool already inserted through the yarn passing eye of the heddle.

The operator on the front side pulls out the tool through the yarn passing eye and draws the warp yarn toward him, thus completing heddling of one warp yarn.

This heddling operation is repeated for each of the warp yarns until all of them are passed through the yarn passing eyes of the heddles specified by the weave construction chart.

Regarding a wide width fabric for which a large number of warp yarns should be used an apparatus for mechanically and automatically passing the warp yarns through the heddle eyes of the respective heddles attached to a heddle frame, had been already developed for the wide width fabric, while regarding a narrow fabric for which a small number of warp yarns should be used, such an apparatus had not yet developed for such a narrow fabric.

A common technical concept for these two cases, is a technical conception in that "a warp yarn is passed through the yarn passing eye of each one of the heddles attached in a heddle frame manually or using a machine".

Such conventional technologies of heddling warp yarns either manually or by using a machine does not beyond the conventional technical conception of passing the warp yarns through the yarn passing eyes of the heddles of the heddle frame.

Accordingly, of preparatory steps for weaving such a fabric, a step of warp heddling which requires many man-hours cannot easily be streamlined or automated, so that many weavers still have to be engaged in manual heddling operation, accompanied by delayed developments of an automatic heddling apparatus for fabrics, thus giving rise to a demand for the streamlining or automated heddling job, based on a novel technological concept.

SUMMARY OF THE INVENTION

It is an object of the present invention to provide an automatic warp heddling method and apparatus which solve the above-mentioned disadvantages of the conventional technologies to mostly automate and greatly streamline the heddling jobs of the preparatory operation steps in fabric weaving process, thus greatly reducing the manufacturing costs.

To this end, the present invention basically employs the following technological conception.

That is, a first aspect of the present invention provides an automatic heddling apparatus wherein a plurality of heddles removed from each one of a plurality of heddle frames are integrally collected into one group in a heddle integrating and holding means, so that each one of flat faces of the respective heddles may face opposite to each other, then a dummy yarn being passed through each one of the heddle eyes provided on each one of the heddles, simultaneously, while the heddles being in a collected state, thereafter each one of the heddles being carried from the heddle integrating and holding means arranged at a collecting position of the heddles to a predetermined respective heddle frame designating section in a heddle frame designating means, individually, while each one of the heddles being engaged with the dummy yarn; while a second aspect of the present invention is an automatic heddling apparatus comprising:

- a heddle integrating and holding means for integrating and holding therein a plurality of heddles taken out from a predetermined number of heddle frames;
- a dummy-yarn insertion means for passing one dummy yarn commonly through a plurality of heddle eyes each being provided respectively on the plurality of heddles held in the heddle integrating and holding means;
- a heddle frame designating means comprising a plurality of heddle frame designating sections each being able to hold one or a plurality of the heddles therein and disposed at the respective positions corresponding to positions at which one or a plurality of the heddle frames being arranged;
- a yarn clipper means which having a function to grip or release the dummy yarn and also having a configuration so as to move from a position in the vicinity of a place at which the heddle integrating and holding means locating, to a predetermined position located at a position opposite to the heddle frame designating means beyond the heddle frame designating means so that the dummy yarn being extended between the predetermined position and the heddle integrating and holding means and to return back to the position in the vicinity of a place at which the heddle integrating and holding means locating, with a predetermined timing, after when the dummy yarn had been extended therebetween;

a heddle gripping and conveying section for taking out one predetermined heddle among the plurality of the heddles from the heddle integrating and holding means and moving the picked up heddle along the extended dummy yarn so as to stack the heddle in a predetermined one of the heddle frame designating sections provided inside the heddle frame designating means;

a first dummy-yarn holding member provided between the heddle integrating and holding means and the heddle frame designating means;

a second dummy yarn holding member provided at a position opposite to the position at which the first dummy-yarn holding member being provided, with respect to the heddle frame designating means ; and dummy-yarn engaging means for performing operations to engage an end portions or a part of the end portions of each one of the dummy yarns with either one of a first and a second dummy-yarn holding members.

BRIEF DESCRIPTION OF THE DRAWINGS

FIG. 1 is a side view for outlining a configuration of one embodiment of an automatic heddling apparatus related to the present invention;

FIG. 2 is a perspective view for showing one embodiment of heddle integrating and holding means related to the present invention;

FIG. 3 is perspective view for explaining a relationship between a heddle frame and heddles related to the present invention;

FIG. 4 is a side view for showing a configuration of an embodiment of a heddle frame designating section and a heddle frame designating means related to the present invention;

FIG. 5 is a perspective view for showing a state where a heddle is conveyed from the heddle frame designating section to a heddle frame related to the present invention;

FIG. 6 is an illustration for explaining one embodiment of the present invention in that a leasing process is applied to a group of the dummy yarns taken out from the heddle frame designating section;

FIG. 7 is an illustration for explaining another embodiment of the present invention in that a leasing process is applied to a group of the dummy yarns taken out from the heddle frame designating section; and FIG. 8 is a side view for showing a configuration of an embodiment of heddle storing means related to the present invention.

DESCRIPTION OF THE PREFERRED EMBODIMENTS

Since an automatic heddling method and apparatus related to the present invention has the above-mentioned technological configuration, it is possible to automatically pass warp yarns of a fabric to be woven on a weaving machine through corresponding heddles of corresponding heddle frames in a preparatory step for weaving the fabric using the weaving machine to thereby streamline and save on a human labor of a job for drawing the warps through the heddles, thus enabling greatly reducing the manufacturing costs as compared to the conventional technologies.

That is, in the present invention, specifically, a plurality of heddles can be removed from the respective heddle frames, each being mounted on a weaving machine, utilizing a specifically designed heddle frame construction in that the heddles can be easily inserted thereunto and removed therefrom.

Then, at a position other than a position on which the weaving machine, An automatic heddling apparatus of the present invention is used to automatically pass a predetermined dummy yarn through all the heddles not by hand.

Subsequently, the heddles through which the predetermined dummy yarn is passed, are all stored in heddle storing means (heddle frame designating section) configured so as to be attachable to or removable from the automatic heddling apparatus.

Each one of the heddles with the dummy yarn passed therethrough, respectively, is inserted into the respective heddle frames which being either dismounted from or mounted on a weaving machine, from the removable heddle storing means (heddle frame designating section), in a sliding manner, easily in short time, with utilizing a suitable device or manually, to thereby arrange a predetermined number of heddles in each one of the heddle frames and to provide a group of the heddle frames in each of which the dummy yarn is passed through each one of the yarn passing eyes provided on all the heddles, automatically and effectively in short time and thereafter, to enable this predetermined number of the heddle to remount on a predetermined weaving machine, thus contributing greatly in reducing the human labor for heddling as compared to the conventional method.

That is, the present invention employs a technological concept of attaching a heddle through which a warp yarn is already passed to a heddle frame to thereby tie the warp yarn in the present invention, this concept being totally different from the conventional technological concept of passing a yarn through a heddle.

Furthermore, in the present invention, each one of the heddles with a yarn as already been passed therethrough, respectively, is configured to be stored in the heddle storing means (heddle frame designating section) so devised as to be easily attached to a heddle frame on a weaving machine, thus making it possible to remount any one of the heddles with a dummy yarn passed therethrough stored in this heddle storing means (heddle frame designating section) to the heddle frame easily in short time by hand or automatically.

By using the above-mentioned automatic heddling apparatus or method related to the present invention, it is possible to automatically pass a warp yarn through a heddle almost without using human labors conventionally used and also to use leasing means mounted on an automatic heddling apparatus to thereby easily tie a warp yarn group made of leased dummy yarns with a regular warp yarns group formally prepared for production of a fabric by using an air splicer, a knotter, etc., in order to automate warp yarn heddling and leasing jobs and facilitate attaching of the heddles with the yarn as passed therethrough to the heddle frame as well as to make it easy to tie the warp yarn group with the dummy yarns, thus reducing the human labors of heddling as used in the conventional method by approximately 75%.

Embodiments

The following will describe embodiments of an automatic heddling method and apparatus related to the present invention.

That is, FIGS. 1 to 3 show a basic configuration of one example of an automatic heddling method related to the present invention, in that an automatic heddling apparatus 100 is shown and which further comprises a plurality of heddles 2 detached from a plurality of heddle frames the are integrally collected with flat faces 11 of the heddles 2 as opposed to each other, a dummy yarn 4 is inserted through a yarn passing eye 3 of each of the plurality of heddles 2 as collected, and each one of the plurality of heddles 2 is individually carried from a collection position 5 thereof from the respective heddle frame designating means 6, respectively, while each one of the heddles being engaged with the dummy yarn.

At the heddle collection position 5 where the heddles 2 are collected as integrated, a heddle integrating and holding means 7 is provided which is so configured as to stack the plurality of heddles 2 with the flat faces 11 thereof as opposed to each other as shown in the figure.

As shown in FIG. 2, for example, the heddle integrating and holding means 7 in the present invention may be comprised of a framework the 3 having a pair of guide portions the 2 with a gap almost the same as a width of the heddles 2 or of a container having a slit matching a shape of the heddles 2.

Furthermore, as shown in FIG. 1, the heddle integrating and holding means 7 may be arranged perpendicularly or inclined by a predetermined angle or in a case may be, it may be configured so as to hold the heddles 21 rein with keeping them in up-right configuration, i.e., perpendicular to the horizontal direction.

Also, the plurality of heddles 2 integrated and held in the heddle integrating and holding means 7 are all required to be arranged so that each one of the yarn passing eyes, i.e., the heddle eyes 3 thereof can be positioned to be coaxially alined with each other.

By using such a configuration of the present invention, it is possible to automatically and instantaneously insert the predetermined dummy yarn 4 through the yarn passing eye 3 of each of the plurality of heddles 2 integrated and held in the heddle integrating and holding means 7, in one time.

Specifically, as shown in FIG. 1, dummy-yarn holding means 8 comprising a yarn bobbin or the like, for holding the dummy yarn 4 is arranged below the hedle integrating and holding means 7 to thereby insert the dummy yarn 4 as taken out from the dummy-yarn holding means 8 commonly through the yarn passing eye 3 of each of the plurality of heddles 2 as a common dummy yarn 4 by using a compressed air or suction air stream or appropriate automatic or manual yarn insertion means 9 provided with a thin guide rod, hook, or the like.

Preferably the end of the dummy yarn 4 having passed through the yarn passing eye 3 of each of the heddles 2 is once engaged at appropriate dummy-yarn end holding means 10.

Furthermore, preferably the dummy-yarn insertion means 9 is configured to be arranged to be moved above the heddle integrating and holding means 7 from a predetermined position at a necessary moment and return to the predetermined position after the dummy yarn 4 had been completely inserted.

Furthermore, the heddle integrating and holding means 7 of the present invention is provided at a bottom thereof with heddle lift-up means 14 for lifting up the plurality of heddle 2 contained therein, at a lower end of the heddle integrating and holding means 7 so that, as mentioned above, the heddles 2 housed in the heddle integrating and holding means 7 may be easily taken out from the heddle integrating and holding means 7, since each one of them is needed to be taken out and to be transferred to a predetermined portion, one by one, respectively.

Such heddle lift-up means the 4 may be comprised of a spring having a predetermined level of resiliency or be configured to move upward at a predetermined pitch in response to the operation of heddle grip means controlling means 35 for the heddles 2.

Furthermore, in the present invention, a plurality of heddle frame designating section 18 are provided in the heddle frame designating means 6 arranged near the heddle integrating and holding means 7, and each one of the heddle frame designating section 18 preferably has a function to hold one or more of the heddles 2 with the dummy yarn 4 inserted therethrough already, therein and is arranged in opposite to each one of a plurality of heddle frames, respectively.

As shown in FIG. 3, the heddle frames the used in the present invention are configured to have a side thereof being easily removable, so that the heddles 2 arranged in the heddle frame the can be taken out of it with a condition in that a frame section 29 of a side thereof is removed and also that, conversely, heddles 2 with the dummy yarn 4 as inserted therethrough, can be inserted in a sliding manner into the heddle frame 1.

That is, as shown in FIG. 4, the heddle frame designating means 6 is provided with a board 19 and, at two ends of the board 19, respectively a plurality of first rod 16, 16', 16", 16'", . . . , arranged in a row with a spacing W intervening interposed therebetween which is roughly equal to the width of the heddles 2 and a plurality of second rods 17, 17', 17", 17'", . . . , arranged as opposed to the first rods 16 with a spacing L interposed therebetween which is roughly equal to the length of the heddles 2, in such a configuration that the first rods 16 and 16' and the second rods 17 and 17' are combined to form the first heddle frame designating section 18 and the first rods 16' and 16"and the second rods 17' and 17" are combined to form the second heddle frame designating section 18'.

Furthermore, preferably a center-to-center spacing X between the first and second heddle frame designating section 18 and 18' is set to be roughly equal to a centerline-to-centerline spacing between a plurality of heddle frames the arranged side by side.

Regarding each one of the individual heddle frame designating sections 18 provided in the heddle frame designating means 6 in the present invention, as described later, since the operation in that a plurality of the heddles 2 being once stacked into each one of the heddle frame designating section 18 and each one of the heddles 2 having the dummy yarn 4 which already been passed through the respective heddle eyes 3 provided on each one of the heddles 2, are collectively moved into each one of the heddle frames the each being arranged in opposite to each one of the heddle frame designating section 18, respectively, is applied to the heddle frame designating section 18, it is preferable in that as shown in FIG. 4, an upper part of each of the heddle frame designating section 18 is kept opened.

Note here that the heddle frame designating means 6 is provided on its front and rear sides thereof with a first dummy-yarn holding member 20-1 and a second dummy-yarn holding member 20-2 for holding the respective ends of the dummy yarn 4, respectively.

Specifically, preferably, between the heddle frame designating means 6 and the heddle frame integrating and holding means 7, is provided the first dummy-yarn holding member 20-1 for engaging one end of the dummy yarn 4 inserted through the heddle 2, while as opposed to the dummy-yarn holding member 20-1 in the heddle frame designating means 6, is provided the second dummy-yarn holding member 20-2 for engaging the other end of the dummy yarn 4 inserted through the heddle 2.

In the present invention, on the other hand, yarn clipper means 15 is provided so as to grip and hold the dummy yarn 4 as inserted through the yarn passing eye 3 of the heddle 2 and one end portion thereof being fixed the dummy-yarn end holding means 10 and yarn clipper means 15 is so configured to move with the dummy yarn to a predetermined yarn clipper movement end position Y.

That is, in the present invention, the yarn clipper means 15 grips the dummy yarn 4 at its end thereof on a portion in the vicinity of the dummy-yarn end holding means 10 as shown in FIG. 1 and moves with the dummy yarn 4 to the yarn clipper movement end position Y beyond the second dummy-yarn-holding member 20-2 so as to extend the dummy-yarn 4 therebetween.

The yarn clipper means 15 is configured so as to return to a yarn clipper means initial position Q in the vicinity of the dummy-yarn end holding means 10 at a predetermined timing after the dummy yarn 4 is extended therefor.

Note here that in FIG. 1, reference numerals 21 and 22 indicate respective yarn guide members provided in a yarn passage over which the dummy yarn 4 is extended, which have a function to grip and release the dummy yarn 4 as well as elevate and lower its position in order to change its yarn passage, and further between the yarn guide member 21 and the dummy-yarn end holding means 10, there is provided a yarn cutter 23 and a yarn gripping section 24 which has a function to grip and release the dummy yarn 4.

Furthermore, in the present invention, a heddle gripping and conveying means 25 is provided in the heddle integrating and holding means 7, to pick up the heddles 2 integrated and held in the heddle integrating and holding means 7 one by one therefrom and convey it along the extended dummy yarn 4, respectively to predetermined one of the heddle frame designating section 18 in the heddle frame designating means 6.

That is, in the present invention, based on information obtained from the weave construction chart of a desired fabric, each one of the heddles 2 is conveyed by the heddle gripping and conveying means 25 along the dummy yarn 4 thus extended, to a specifically selected heddle frame designating section 18 among a plurality of the heddle frame designating sections 18, in the heddle frame designating means 6, and which corresponding to a specifically designated heddle frame the.

The heddle gripping and conveying means 25 has means for gripping the heddles 2 by utilizing by a suction means, an electromagnetic mechanism or a mechanical mechanism, so as to perform an operation for gripping each one of the heddle 2 and for conveying the same, respectively.

The heddle gripping and conveying means 25 also has a function to release the heddle 2 at a place corresponding to the specifically designated heddle frame designating section 18 in the heddle frame designating means 6 so as to insert the heddle 2 which still keeping the dummy yarn 4 passed through the heddle eyes provided on each one of the heddles 2, into the heddle frame designating section 18, respectively.

In this case, the heddle gripping and conveying means 25 may just carry the heddle 2 into the predetermined heddle frame designating section 18 by gravity fall in natural or may also use appropriate descending means as well to insert the heddle 2 into the heddle frame designating section 18.

In such an operation of carrying the heddle 2 into the heddle frame designating section 18, it is also preferable to cause the yarn guide members 21 and 22 to lower as indicated by an arrow Z in FIG. 1.

In such a configuration, the dummy yarn 4 can be easily engaged with the first and second dummy-yarn holding members 20-1 and 20-2, respectively, so that each one of the end portions of the dummy yarns 4 is easily held by the dummy yarn end gripping mechanism provided at these dummy-yarn holding members 20-1 and 20-2.

Then, the yarn clipper 15 releases the end of the dummy yarn 4 to then return to the yarn clipper means initial position Q, while at the same time, on the side of the first dummy-yarn holding member 20-1, with the yarn gripping section 24 as gripping the dummy yarn 4, the yarn cutter 23 cuts the dummy yarn 4 extended between the yarn gripping section 24 and the first dummy-yarn holding member 20-1.

Then, the yarn guide members 21 and 22 release the end of the dummy yarn 4 and returns to a position along the passage over which the dummy yarn 4 is extended and then releases the dummy yarn 4 to stand by for receiving the next dummy yarn 4.

Furthermore, after having carried the heddle 2 to the predetermined one of the heddle frame designating section 18, the heddle gripping and conveying means 25 returns to a heddle gripping and conveying section initial position P as shown in FIG. 1 to stand by for causing the next heddle 2 to be moved, while at the same time, after having released the end of the dummy yarn 4, the yarn clipper means 15 also returns to the yarn clipper means initial position Q in the vicinity of the heddle integrating and holding means 7 and grips the dummy yarn 4 extended over between the dummy-yarn holding means 10 and the yarn gripping section 24 to prepare for the next operation.

Then, the yarn gripping section 24 releases the dummy yarn 4 from a gripped state and once evacuates from the moving passage of the yarn clipper means 15 together with the yarn cutter 23 and then stands by.

Hereafter, the above-mentioned steps are repeated sequentially.

In the present invention, when these steps are performed to carry the respective heddles 2 individually from the heddle integrating and holding means 7 to a predetermined individual one of the heddle frame designating section 18 in the heddle frame designating means 6, the dummy yarn 4 is cut so that a predetermined length of the dummy yarn 4 may be kept before and after each of the heddles 2 and these end portions of the dummy yarn may be securely held by a predetermined method.

Furthermore, in the present invention, when each one of the heddles 2 is carried along the dummy yarn 4, respectively, one end portion of the dummy yarn 4, is carried from the heddle integrating and holding means 7 over the heddle frame designating means 6 to the predetermined yarn clipper movement end position Y, where it is gripped by the predetermined second dummy-yarn holding member 20-2.

Furthermore, in the configuration in the present invention, when the heddles 2 are each carried, part of the dummy yarn 4 which is arranged opposite to the one end of the dummy yarn 4 in the heddle frame designating means 6 and also which is extended into an automatic heddling apparatus for the heddles is cut at the predetermined position between the heddle integrating and holding means 7 and the heddle frame designating means 6 to be gripped by a predetermined second dummy-yarn holding section 20-1.

Furthermore, in the present invention, preferably, leasing means 26 is provided between the heddle frame designating means 6 and the second dummy-yarn holding member 20-2.

That is, in the present invention, one end of the dummy yarn 4 gripped by the second dummy-yarn holding member 20-2 is leased as gripped by the second dummy-yarn holding member 20-2.

The number of the leasing members 26 is not limited to one; for example, it is possible that each one of the dummy yarns 4 to be passed through either one of the heddles 2 for the ground yarns, for the selvage yarns, for connecting yarns or the like, can be leased by different leasing means 26 from each other, respectively.

As is clear from the plan view of FIG. 6 illustrating an automatic heddling apparatus 100 for the heddles in the present invention, each one of the leasing means 26 is provided with two leasing bars 27 arranged on a rotary substrate 28 so as to oppose to each other with respect to a rotation center thereof, which rotary board 28 is configured so as to rotate by 90 degrees at each time when one of the dummy yarns 4 is inserted in order to insert a predetermined leasing yarn into its own space formed between those two bars.

And in this embodiment, three leasing means 26 is provided.

Furthermore, in the present invention, although there is no restricted method provided in particular for shifting each one of a plurality of heddles 2 each having the dummy yarn 4 which passing through the respective heddle eye 3 provided on each one of the heddles, and each of which being held in a stacked configuration, in the relevant heddle frame designating section 18 in the heddle frame designating means 6, into each one of the corresponding heddle frames the provided as opposed to the respective heddle frame designating section 18, for example, as shown in FIG. 1, the heddle frame designating means 6 arranged on the flat plate may be rotated by 90 degrees to cause an end opening 50 in the respective heddle frame designating section 18 to be directly aligned with a space formed in a frame of the specifically designated heddle frames the, so that subsequently an appropriate apparatus, a jig, the finger tip, or the like, can be used to shift the plurality of heddles 2 held as stacked in the relevant heddle frame designating section 18 in the heddle frame designating 6 in a sliding manner into the heddle frame the provided as opposed to each of the heddle frame designating section 18.

Furthermore, in the present invention, the heddle frame designating means 6 may be provided at each of its sites with the heddle frame designating section 18 which integrates the heddles 2, and the heddle frame designating means 6 is configured so that it can be stored at a predetermined site apart from this apparatus, with a predetermined number of the heddles 2 having the dummy yarn 4 inserted therethrough and which being integrated in each of the respective heddle frame designating section 18 of the heddle frame designating means 6, or a group of heddle frames, each containing a plurality of heddles 2 each having the dummy yarn 4 inserted therethrough, can be stored at the above-mentioned predetermined site, after each one of a plurality of heddles 2 had been inserted into each one of the heddle frames the, respectively.

In the configuration in the present invention, after each one of the heddles 2 collected and stacked in the heddle integrating and holding means 7 is all carried into the specified respective heddle frame designating section 18 in the heddle frame designating means 6 with the dummy yarn 4 as inserted therethrough according to the above-mentioned method and procedure and then all of the heddles 2 held in the respective heddle frame designating section 18 with the dummy yarn as inserted therethrough are simultaneously transferred into the heddle frames the arranged in opposite to correspondence to the respective heddle frame designating section 18 or before the heddles are transferred into these heddle frames the, each one of a plurality of end portions of the second dummy-yarn group ends 62 of the dummy yarns 4 being already leased and gripped by the second dummy-yarn holding member 20-2, is sequentially connected to the respective ends of a group of warp yarns already warped by another step, starting from the outermost one of the warp yarn group.

Such an operation of tying the warp yarns can be carried out using a publicly known automatic yarn tying apparatus, an air splicer, or the like.

Similarly, after or before one group or more of the heddles 2 stacked in the respective heddle frame designating section 18 in the heddle frame designating means 6 are inserted in a sliding manner into the respective heddle frames the arranged in correspondence thereto with the dummy yarn 4 as inserted therethrough, a group of the yarn end portions of the first dummy-yarns 6the of the plurality of dummy yarns 4 gripped by the first dummy-yarn holding member 20-1 is connected to a predetermined winging means, that is, a fabric winding roller or the like for winding up a fabric would be woven later on.

Preferably the various means or devices provided to An automatic heddling apparatus 100 according to the present invention are configured so as to operate at a predetermined timing according to a predetermined program to thereby automatically perform all the operations such as insertion of the dummy yarn 4 through the heddles 2, picking up and carriage of each of the heddles 2 by the heddle gripping and conveying means 25, carriage of the dummy yarn 4 by the yarn clipper means 15, an operation of the yarn guide members 21 and 22, holding and releasing of the dummy-yarn holding members 20-1 and 20-2, an operation of the yarn gripping section 24 and the yarn cutter 23, cutting of the dummy yarn 4, or the like.

To carry out these operations of the present invention, as shown in FIG. 1, preferably there are provided fabric construction information storage means 30 for storing information of an weave construction chart showing a desired construction of a fabric to be woven beforehand, control information generation means 3 the for generating, based on the fabric construction information stored in this fabric construction information storage means 30, control information as to indicate to which one of the heddle frames the a predetermined heddle 2 with the dummy yarn 4 as inserted therethrough already is to be transferred and control information as to include designation of the respective position of the heddle frame designating section 18 in the heddle frame designating means 6 as to correspond to the heddle frame the, operation control means 32 for processing various operations by these means based on the control information sent from this control information creation means 31 and for outputting the respective control signals, and dummy-yarn insertion means drive control means 33, yarn clipper drive control means 34, heddle gripping means drive control means 35, yarn guide member drive control means 36, first dummy-yarn holding member drive control means 37, second dummy-yarn holding member drive control means 38, yarn gripping member and cutter means drive control means 39 each one of which are all connected to this operation control means 32, for example.

That is, for example, if when the information, based upon a desired fabric construction set in the fabric construction information storage means 30 is output to instruct that the first heddle 2 should be inserted into the third heddle frame 1-3, the third heddle frame designating section 18-3 which corresponds to this third heddle frame 1-3 is selected, so that the heddle gripping and conveying means 25 picks up the first heddle 2 from the heddle integrating and holding means 7 and moves it along the extended dummy yarn 4 and then inserts it with the dummy yarn 4 as inserted therethrough, in the third heddle frame designating section 18-3.

Similarly, if when the information is output to instruct that the second heddle 2 should be inserted into the first heddle frame 1-1, the heddle frame designating section 18-1 which corresponds to this first heddle frame 1-1 is selected, so that the heddle gripping and conveying means 25 picks up the second heddle 2 from the heddle integrating and holding means 7 and moves it along the extended dummy yarn 4 and then inserts it with the dummy yarn 4 as inserted therethrough, in the first heddle frame designating section 18-1.

Such operations are sequentially repeated automatically until a time when a certain number of the heddles among the heddles stacked in the heddle integrating and holding means 7, corresponding to the number designated by the fabric construction information storage means 30, have completely be transferred into all of the respective heddle frame designating sections 18 of the heddle frame designating means 6.

Upon completion of the operation, a predetermined number of the heddles 2 are stacked into each one of the heddle frame designating section 18 of the heddle frame designating means 6 and a predetermined length of the dummy yarn 4 as inserted through the yarn passing eye 3 of each of the heddles 2, formed by cutting operation, is disposed on both sides of the respective heddle frame designating section 18, thus forming a shape of a heddling processing component 63 as to have the first and second dummy-yarn ends groups 6 the and 62 formed at the two ends of each one of the heddle frame designating section 18, respectively.

In the present invention, the heddling processing component 63 may be stored as thus shaped at a predetermined department and then picked up at a necessary moment and supplied to the heddle frame 1.

The above-mentioned operations of the automatic heddling method by use of an automatic heddling apparatus for the heddles 2 related to the present invention are more detailed as follows: first, the plurality of heddles 2 are collected and stacked in the heddle integrating and holding means 7 with their respective flat faces 11 as opposed to each other, and the dummy yarn 4 is inserted through the coaxially arranged yarn passing eyes 3 of these heddles 2 and it is held at its two ends thereof as extended over between the dummy-yarn end holding means 10 and the yarn gripping section 24.

Then, based on a operation instruction from the yarn clipper control means 32, the yarn clipper means 15 grips the dummy yarn 4 extended over between the dummy-yarn end holding means 10 and the yarn gripping section 24 at the yarn clipper means initial position Q near the heddle integrating and holding means 7.

At this moment, the yarn gripping section 24 and the dummy-yarn end holding means 10 stop gripping of the dummy yarn 4 and release it and then withdraw by its-self from the position as it was to such a position as not to interfere with the movement of the yarn clipper 15, thus standing by in preparation for the next operation.

Then, the yarn clipper means 15 moves as gripping the dummy yarns 4 over the heddle frame designating means 6 to the yarn clipper movement end position Y outside the second dummy-yarn holding section 20-2 while at the same time stretching the dummy yarns 4.

In this case, as the yarn clipper means 15 moves, the dummy yarns 4 slides through the yarn passing eyes 3 in each of the heddles 2 in the heddle integrating and holding means 7 to be sequentially pulled out from the dummy-yarn holding means 8 in configuration.

In some cases, the yarn clipper means 15 may hand over the gripping of the dummy yarns 4 to the yarn guide member 22 to return to the above-mentioned yarn clipper means initial position Q in configuration.

As mentioned above, such a yarn guide member 22 functions to lower its position while it gripping the dummy yarns 4, to thereby engages the ends of the dummy yarns 4 with the second dummy-yarn holding member 20-2.

Meanwhile, in the present invention, the leasing means 26 rotates by 90 degrees to form a lease in the dummy yarns 4 when they have passed the center thereof.

The leasing means 26 according to the present invention repeatedly rotates in normal and reverse directions by 90 degrees at each time when the yarn passes therethrough, thus forming a lease in a group of the dummy yarns 4 when they have passed through the mechanism.

Then, by applying some time difference with respect to the movement of the yarn clipper means 15, the heddle gripping and conveying means 25 moves to the position of the heddle integrating and holding means 7 to pick up, by vacuum-suction mechanism or the like, the first heddles 2 provided on the top surface of the group of the heddles 2 stored in the heddle integrating and holding means 7, so that the designated No. of the heddle frame the into which the picked up heddles 2 should be inserted, which had already been registered in the heddle gripping means control means 35 and the information of the individual heddle frame designating section 18 corresponding to the above-mentioned heddle frame number in the heddle frame designating means 6 are readout and,based on this information, the yarn clipper means 15 conveys the first heddle 2 along the dummy yarn 4 to carry this heddle 2 with the dummy yarn 3 as inserted therethrough, into the predetermined heddle frame designating section 18.

Then, the yarn gripping section 24 and the dummy-yarn end holding means 10 approach the dummy yarn 4 to grip it, while at the same time the yarn guide member 21 also approach the dummy yarn 4 to grip it and then, as mentioned above, the yarn guide member 21 is descended as gripping the dummy yarn 4 to engages the other end of the dummy yarn 4 with the first dummy-yarn holding member 20-1.

Then, the yarn cutter 23 provided between the yarn guide member 21 and the tread gripping section 24 is driven to cut the dummy yarn 4 extended between the yarn guide member 21 and the yarn gripping section 24, thus completing the first step.

Next, in the second step, similarly, the yarn clipper means 15 clips the dummy yarn 4 extended between the dummy-yarn end holding means 10 and the yarn gripping section 24 at the yarn clipper means initial position Q to move to the predetermined yarn clipper movement end position Y, so that subsequently the heddle gripping and conveying means 25 picks up the second heddle 2 from the heddle integrating and holding means 7 to carry it to a particular one of the heddle frame designating section 18 in the heddle frame designating sections 6 specified by the heddle gripping means control means 35 separately along the extended dummy yarn 4 so as to insert it with the dummy yarn 4 as inserted therethrough, in this specified section 18.

These steps will be repeated until the time when a predetermined number of the heddles 2 integrated and stored in the heddle integrating and holding means 7, corresponding to the number designated by the fabric information storage means as mentioned above, had been transferred and whereupon the automatic heddling method in the present invention ends.

Note here that although the second dummy-yarn group ends 62 in the present invention is engaged with the second dummy-yarn holding member 20-2, ultimately, all of the end portions of the second dummy-yarn yarn ends group 62 are stored with their ends as bonded.

The second dummy-yarn end portions group 62 of the dummy yarns 4 in the present invention, on the other hand, are stored after a leasing yarn 64 is passed through a group of the dummy yarns 4 formed a lease alternatively therein, after when they have passed the leasing means 26.

Furthermore, the other ends of the dummy yarns 4, that is, the first dummy-yarn group ends 61 are also engaged with the first dummy-yarn holding member 20-1 and finally are stored with the ends as bonded.

Furthermore, in the present invention, as mentioned above, preferably heddle storage means 70 is used to store the heddles 2 through which the dummy yarn 4 has passed so that they may not move using predetermined holding means.

The heddle storage means 70 is comprised of a framework 7 the such as shown in FIG. 8, for example, and preferably has such a shape and size as to house the mechanisms of the heddle frame designating means 6 as they are and also such a configuration and mechanism as to be attached to and detached as it is from An automatic heddling apparatus 100 for these heddles.

Therefore, in the present invention, the heddle storage means 7 in which the heddles 2 are stored is fixed so that they may not move, then the heddle storage means 70 is removed together with a bundle of groups of the dummy yarns 4 from the automatic heddling machine 100 for these heddles, and then in this state the group of the heddles 2 stored in the heddle storage means 70 with the dummy yarn 4 as inserted therethrough are inserted in a sliding manner into the heddle frame the on a weaving machine, thus completing the preparation of mounting.

Furthermore, the present invention can accommodate a fabric with a complicated weaving organization, in particular; for example, in the case of an automatic heddling apparatus for such a heddle as to be used for a narrow fabric having a double- or triple-weaving construction, it is possible to accommodate it by complicating the leasing means 26 and the yarn clipper means 15 or the dummy-yarn holding section 20-2 or the like.

For example, as for the leasing means, besides the means for leasing warp yarns used as ground warp yarns, core-warp yarns leasing means, connecting warp yarns leasing means, or the like, can be provided in addition.

In this case, in the control device, information about each one of the warp yarn to be engaged with the heddling operation as used in forming a narrow fabric and information about all respective heddle frame numbers to which each one of the warp yarns should be belonged to on the loom, designated by the weave construction chart, should be registered, for example, sequentially from one outer most end portion of the group of the warp yarns, as well as information about the positions of the leasing means and the yarn clipping means should be registered with respect to each one of the warp yarns, respectively.

The following will describe how to mount the group of the heddles 2 through which the dummy yarn 4 has passed, on the weaving machine, according to the present invention.

That is, the group of the heddles 2 with the dummy yarn 4 as passed therethrough already which are stored in the heddle storage means 70 related to the present invention that corresponds to each of the heddle frames the on a weaving machine having regular warp yarns as prepared for weaving are moved and mounted to a conventional warp yarn supplying apparatus.

Specifically, first, the first dummy-yarn end portions group 61 is connected to a winding roller of the weaving machine and the second dummy-yarn end portion group 62 is faced to a direction from which the warp-yarn being supplied and then the position of the heddle frame designating section of the heddle storage means 70 is aligned with the respective position of the heddle frame the having the corresponding number thereto, then the group of the heddles 2 stored in each of the heddle frame designating section 18 with the dummy yarn 4 as inserted therethrough, are inserted into the corresponding heddle frame the and thereafter fixed by attaching each spring clip, support guide, or the like, to the heddle frames the.

A dummy yarn 4 is passed through a predetermined front reed as lining up the yarns on the side of the first dummy-yarn ends group 61 to then wind us this first dummy-yarn ends group 6 the onto a winding roll of the weaving machine.

Next, as lining up the yarns of the second dummy-yarn ends group 62, the second dummy-yarn ends group 62 is moved close to the warp yarn supplying apparatus by passing same over a tension bar or the like, in a case may.

Each one of the regular warp yarns is sequentially connected to each one of the corresponding to the second dummy-yarn ends group 62, respectively, to which the above-mentioned leasing operation had been applied, from one end of the group of the dummy yarns 4.

The warp yarns can be connected with each other in shorter time by using an air splicer, knotter, or the like.

Furthermore, the winding roll is rotated to wind up thereon the connected portion of the dummy yarn group and the warp yarns or to pull them out from the weaving machine and abandon them, thus ending the heddling operation of the warp yarns.

Weft yarns, locking yarns, or the like are woven into the regular warp yarns prepared on the weaving machine by the abovementioned weaving operation.

The above-mentioned automatic heddling method according to the present invention basically comprises the steps of:

- detaching a plurality of heddles 2 from a plurality of heddle frames the; integrally collecting the plurality of heddles 2 thus detached from the heddle frames the in such a manner that flat faces 11 thereof may face opposite to each other and storing them with keeping it collected condition in the predetermined heddle integrating and holding means 7;
- passing one dummy yarn 4 simultaneously through yarn passing eyes 3 provided in each one of the integrated plurality of heddles 2, respectively;
- holding one end of the dummy yarn 4 passing commonly through the yarn passing eyes 3 of the plurality of heddles as extended over the dummy-yarn end holding means 10 and the yarn gripping section 24;
- causing the movable yarn clipper means 15 to grip the end of the dummy yarn 4 engaged with the dummy-yarn end holding means 10 and also causing the dummy-yarn holding means 10 to release the engagement of the dummy yarn 4;
- causing the yarn clipper means 15 to move to a position at which the dummy yarn 4 is to be engaged to the second dummy-yarn holding member 20-2 beyond the heddle frame designating means 6 for each of the heddles 2, while it gripping one end portion of the dummy yarn 4.
- causing the yarn clipper means 15 to release the gripping of the dummy yarn 4 after the dummy yarn 4 had been engaged with the second dummy yarn holding member 20-2;
- causing the heddle gripping and conveying means 25 to grip the first heddle 2 positioned at the outermost position of a group of the plurality of heddles 2 collected in the heddle integrating and holding means 7 therefrom and to move the heddle 2 into one of the heddle frame designating section 18 provided in the heddle frame designating means 6 as sliding it along the dummy yarn 4 extended over between the heddle integrating and holding member 7 and the second dummy-yarn holding member 20-2, to supply this heddle 2 into this heddle frame designating section 18;

engaging the dummy yarn 4 extended over between the heddle frame designating section 18 and the yarn gripping section 24 with the first dummy-yarn holding member 20-1 provided between the heddle frame designating means 6 and the yarn gripping section 24, after the heddle 2 had been delivered into the specifically designated;

causing the yarn gripping section 24 to grip the dummy yarn 4 again; heddle frame designating section 18 causing the yarn cutter 23 to cut the dummy yarn 4 extended over between the first dummy-yarn holding member 20-1 and the yarn gripping section 24;

returning the yarn clipper means 15 from the yarn clipper movement end position Y to the yarn clipper means initial position Q to grip the end of the dummy yarn 4 engaged by the yarn gripping section 24; and repeating the above-mentioned steps starting from the first one.

Preferably this automatic heddling method has an additional step of leasing the dummy yarn 4 at each time when it is engaged with the second dummy-yarn holding member 20-2, using the leasing means 26 provided between the second dummy-yarn holding member 20-2 and the heddle frame designating means 6.

Furthermore, in the present invention, preferably there is provided an additional step of moving the heddles 2 one by one into the heddle frame designating section 18 in the heddle frame designating means 6 which corresponds to a specifically designated one of the heddle frames the to then stack them therein based on the control information obtained from a weave construction chart of a desired fabric.

Besides, in the present invention, preferably there is provided an additional step of moving the heddle 2 by an automatic heddle carrying apparatus whose gripping and moving operations are controlled on the basis of the control information obtained from the weave construction chart of the desired fabric.

Also, in the present invention, preferably there is provided an additional step of causing all the yarn gripping section 24, the first dummy-yarn holding members 20-1 and the second dummy-yarn holding members 20-21 yarn clipper means 15, the yarn cutter 23, or the like to perform the operations of yarn gripping, yarn engaging, yarn clipping, yarn separating, yarn cutting, or the like all based on the weave construction chart of the desired fabric.

Furthermore, in the present invention, preferably there is provided an additional step of inserting in a sliding manner one group or more of heddles 2 stacked in the respective heddle frame designating section 18 in the heddle frame designating means 6 with the dummy yarn 4 as inserted therethrough into the respective heddle frames the arranged correspondingly.

Furthermore, in the present invention, most preferably there are provided an additional step of, after the heddles collected in the heddle integrating and holding means 7 are all supplied into the respective heddle frame designating section 18 in the heddle frame designating means 6, fixing the end of the all the dummy yarns 4 engaged at the first dummy-yarn holding member 20-1 to a predetermined fabric winding roller and another step of connecting the ends of all the dummy yarns 4 engaged at the second dummy-yarn holding member 20-2 to the respective ends of a group of warp yarns already warped starting from the outermost one sequentially through an automatic yarn tying apparatus.

Also, an automatic heddling apparatus 100 for the heddles related to the present invention may specifically comprise:

the heddle integrating and holding means 7 for integrating and holding the plurality of heddles 2 removed from a predetermined number of heddle frames 1;

the dummy-yarn insertion means 9 for inserting one dummy yarn 4 commonly through the respective yarn passing eyes 3 of the plurality of heddles 2 held in the heddle integrating and holding means 7;

the heddle frame designating means 6 including a plurality of heddle frame designating section 18 which can store one or a plurality of the heddles 2 each of which being arranged opposite to each one of the heddle frame 1;

the yarn clipper means 15 which has a function to grip and release the dummy yarn 4 and also which moves the dummy yarn 4 from a vicinity of the arranging position of the heddle integrating and holding means 7 over the heddle frame designating means 6 to a predetermined position opposite the heddle frame designating means 6 while at the same time stretching over the dummy yarn 4 and then returns to the vicinity of the arranging position of the heddle integrating and holding means 7 at a predetermined timing;

the heddle gripping and conveying means 25 for picking up a predetermined one of the heddles 2 from the heddle integrating and holding means 7 to move it along thus extended dummy yarn 4 and stack it in a predetermined one of the heddle frame designating section 18;

the first dummy-yarn holding member 20-1 provided between the heddle integrating and holding member 7 and the heddle frame designating means 6;

the second dummy-yarn holding member 20-2 provided as opposite to the first dummy-yarn holding member 20-1 in the heddle frame designating means 6; and the dummy-yarn engagement means for engaging an end or part of the dummy yarn 4 with the first and second dummy-yarn holding members 20-1 and 20-2.

Furthermore, in an automatic heddling apparatus 100 for the heddles related to the present invention, preferably there is provided at least one leasing means 26 between the heddle frame designating means 6 and the second dummy-yarn holding member 20-2 and also preferably there is provided between the heddle integrating and holding means 7 and the first dummy-yarn holding member 20-1, the yarn cutter 23 for cutting the dummy yarn 4 extended over between the heddle integrating and holding means 7 and the first dummy-yarn holding member 20-1.

Also, in An automatic heddling apparatus 100 for the heddles related to the present invention, preferably there is heddle insertion means for individually inserting in a sliding manner, one group of more of the heddles 2 stacked in the respective heddle frame designating section 18 of the heddle frame designating means 6 with the dummy yarn 4 as inserted therethrough into each one of the heddle frames the arranged in opposition to the respective heddle frame designating section 18 and also preferably there is provided automatic control means for individually controlling the operations of the means according to a predetermined program.

Furthermore, in an automatic heddling apparatus 100 for the heddles related to the present invention, preferably the automatic control means is configured so as to be driven on the basis of weave construction information of a construction of a desired fabric and more preferably there is provided the heddle storage means 70 for storing therein both the groups of heddles 2 held as stacked in the respective heddle frame designating section 18 of the heddle frame designating means 6 and the dummy yarns 4 inserted through the yarn passing eyes 3 of the respective heddles 2 as they are.

That is, in the present invention, there is provided the heddle storage means 70 for storing therein as they are the plurality of heddle frames the arranged in correspondence to the respective heddle frame designating section 18 into which heddle frames the are inserted in a sliding manner the group of the heddles 2 held as stacked in the respective heddle frame designating section 18 of the heddle frame designating means 6 and the dummy yarns 4 as inserted through the respective heddles 2.

Another embodiment of the present invention provides a method for heddling as well as a program for causing a computer to execute the automatic heddling method for the heddles.

The method for heddling of the present invention comprising the steps of:

removing a plurality of heddles from a plurality of heddle frames;

integrally collecting a plurality of the heddles thus removed from the heddle frames in such a manner that flat faces of the heddles may face opposite to each other and storing the heddles as collected in predetermined heddle integrating and holding means;

passing one dummy yarn simultaneously through all of heddle eyes provided on each one of the heddles, as collected, respectively;

holding one end of the dummy yarn passing commonly through all of the heddle eyes of each one of the plurality of heddles, at a first dummy-yarn holding member;

causing a movable yarn clipping means to grip the end of the dummy yarn engaged at the dummy-yarn holding member and simultaneously with this, causing the dummy-yarn holding member to release the engagement of the dummy yarn;

causing the yarn clipper means to move to a position at which the dummy yarn is to be engaged with a second dummy-yarn holding member, beyond each one of heddle frame designating sections each corresponding to the respective heddles, while the yarn clipping means is gripping the end portion of the dummy yarn;

causing the yarn clipper means to engage an end portion of the dummy yarn after the dummy yarn with a second dummy yarn holding member and thereafter, causing the yarn clipper means to release the engagement of the end portion of the dummy yarn;

causing a heddle gripping and conveying section to grip a first heddle arranged at the most end position among a plurality of the stacked heddles which being collected inside of the heddle integrating and holding means and causing the heddle gripping and conveying section to transfer the heddle thus gripped thereby to one of the heddle frame designating sections each being provided within the heddle frame designating means, with a sliding manner along the dummy yarn extended between the heddle integrating and holding means and the second dummy yarn holding member so as to deliver the heddle to a desired heddle frame designating section;

engaging the dummy yarn extended between the heddle frame designating means and the yarn gripping means with the first dummy yarn holding member provided between the heddle frame designating means and the yarn gripping means extended over between the heddle frame designating block and the yarn gripping section to the first dummy-yarn holding member, after the respective heddle had been delivered into specifically designated heddle frame designating section;

causing the yarn gripping means to grip the dummy yarn again;

causing a yarn cutter to cut the dummy yarn extended between the first dummy-yarn holding member and the yarn gripping means;

returning the yarn clipper means from a position in the vicinity of the second dummy-yarn holding member to a position in the vicinity of the first dummy-yarn holding member and to grip again an end portion of the dummy yarn engaged with the yarn gripping means; and repeating the above-mentioned steps starting from the first step.

Further, a program for automatically heddling of the present invention is a program for causing a computer to execute an automatic heddling method, the method comprising the steps of:

removing a plurality of heddles from a plurality of heddle frames;

integrally collecting a plurality of the heddles thus removed from the heddle frames in such a manner that flat faces of the heddles may face opposite to each other and storing the heddles as collected in predetermined heddle integrating and holding means;

passing one dummy yarn simultaneously through all of heddle eyes provided on each one of the heddles, as collected, respectively;

holding one end of the dummy yarn passing commonly through all of the heddle eyes of each one of the plurality of heddles, at a first dummy-yarn holding member;

causing a movable yarn clipping means to grip the end of the dummy yarn engaged at the dummy-yarn holding member and simultaneously with this, causing the dummy-yarn holding member to release the engagement of the dummy yarn;

causing the yarn clipper means to move to a position at which the dummy yarn is to be engaged with a second dummy-yarn holding member, beyond each one of heddle frame designating sections each corresponding to the respective heddles, while the yarn clipping means is gripping the end portion of the dummy yarn;

causing the yarn clipper means to engage an end portion of the dummy yarn after the dummy yarn with a second dummy yarn holding member and thereafter, causing the yarn clipper means to release the engagement of the end portion of the dummy yarn;

causing a heddle gripping and conveying section to grip a first heddle arranged at the most end position among a plurality of the stacked heddles which being collected inside of the heddle integrating and holding means and causing the heddle gripping and conveying section to transfer the heddle thus gripped thereby to one of the heddle frame designating sections each being provided within the heddle frame designating means, with a sliding manner along the dummy yarn extended between the heddle integrating and holding means and the second dummy yarn holding member so as to deliver the heddle to a desired heddle frame designating section;

engaging the dummy yarn extended between the heddle frame designating means and the yarn gripping means with the first dummy yarn holding member provided between the heddle frame designating means and the yarn gripping means extended over between the heddle frame designating block and the yarn gripping section to the first dummy-yarn holding member, after the respective heddle had been delivered into specifically designated heddle frame designating section;

causing the yarn gripping means to grip the dummy yarn again;

causing a yarn cutter to cut the dummy yarn extended between the first dummy-yarn holding member and the yarn gripping means;

returning the yarn clipper means from a position in the vicinity of the second dummy-yarn holding member to a position in the vicinity of the first dummy-yarn holding member and to grip again an end portion of the dummy yarn engaged with the yarn gripping means; and repeating the above-mentioned steps starting from the first step.

An automatic heddling apparatus and method for heddles related to the present invention employs the above-mentioned technological configuration and so can utilize such a construction of a heddle frame that the heddles can be easily attached to and detached from the heddle frame mounted to a weaving machine, to remove the heddles from the weaving machine to its outside, automatically pass a dummy yarn through the heddles, thus providing such a heddle that the dummy yarn is passed therethrough not by hand on An automatic heddling apparatus for the heddles installed at a different position from that of the weaving machine.

Then, the heddle with the dummy yarn as inserted therethrough is stored automatically in the heddle storage means on An automatic heddling apparatus.

In the present invention, the heddles with the dummy yarn passed therethrough can be easily remounted into the heddle frame on the weaving machine manually or automatically in short time, thus reducing the human labors of heddling by use of the conventional method by approximately 75%.

What is claimed is:

1. An automatic heddling apparatus comprising:

a heddle integrating and holding means provided at a collecting position of heddles and in which a plurality of heddles removed from each one of a plurality of heddle frames are integrally collected into one group so that each one of flat faces of said respective heddles may face opposite to each other, a dummy yarn supplying means whereby a dummy yarn is passed through heddle eyes provided on each one of said heddles, simultaneously, while said heddles are in a collected state, a heddle frame designating means having a plurality of heddle frame designating sections therein, and a heddle carrying means which carries each one of said heddles from said heddle integrating and holding means to said predetermined respective heddle frame designating section in said heddle frame designating means, individually, while each one of said heddles is engaged with said dummy yarn.

2. An automatic heddling apparatus according to claim 1, wherein each one of said heddle frame designating sections has a function to hold one or a plurality of the heddles therein and being arranged so as to oppose to each one of a plurality of heddle frames, respectively.

3. An automatic heddling apparatus according to claim 1 or 2, wherein each one of said heddles is individually carried into one of the heddle frame designating sections corresponding to a specifically selected held frame among said heddle frames, based on information obtained from a weave construction chart of a desired fabric.

4. An automatic heddling apparatus according to claim 1 or 2, wherein said apparatus is provided with a cutting mechanism whereby said dummy yarn is cut so that a predetermined length of said dummy yarn can be remained both in front side of and in back side of said heddle, when each one of said heddles is respectively carried into said predetermined individual heddle frame designating section from said heddle integrating and holding means.

5. An automatic heddling apparatus according to claim 1 or 2, wherein, when each one of said heddles is carried individually to said heddle frame designating means, one end of said dummy yarn is carried from said heddle integrating and holding means to a predetermined position through each said heddle frame designating section, where said one end thereof is gripped by a predetermined second dummy-yarn holding member.

6. An automatic heddling apparatus according to claim 1 or 2, wherein, when each one of said heddles has been carried individually to said heddle frame designating means, a part of said dummy yarn which is extended between said heddle frame designating means and said heddle integrating and holding means is cut at a predetermined position there and the cut end portion of said dummy yarn connected to said heddle frame designating means is gripped by a predetermined first dummy-yarn holding member.

7. An automatic heddling apparatus according to claim 1 or 5, wherein each one of the end portions of said dummy yarns is gripped by said second dummy-yarn holding member, so that a second yarn ends group of said dummy-yarns, is leased when they are gripped by said second dummy-yarn holding member.

8. An automatic heddling apparatus according to claim 1 or 2, wherein one or a plurality of groups of the heddles stacked in said respective heddle frame designating section is inserted, with a sliding manner, into each one of said respective heddle frames arranged correspondingly to each one of said heddle frame designating sections, with the dummy yarn being inserted through said heddle eyes of said respective heddles.

9. An automatic heddling apparatus according to claim 8, wherein, after all of said one or the plurality of groups of the heddles stacked in the respective heddle frame designating sections have been inserted, with a sliding manner, into each one of said respective heddle frames arranged correspondingly to each one of said heddle frame designating sections, with the dummy yarn being inserted through said heddle eyes of said respective heddles, each one of said end portions of a plurality of said second yarn ends group of said dummy-yarns, which are gripped by said second dummy-yarn holding member and being already leased with each other, being sequentially connected to each one of end portions of a group of warp yarns to which a warping treatment had already been completed, respectively, starting from the outer most end dummy yarn and warp yarn in one side thereof to the outer most end dummy yarn and warp yarn in an opposite side thereof.

10. An automatic heddling apparatus according to claim 8, wherein, after all of said one or the plurality of groups of the heddles stacked in the respective heddle frame designating sections had been inserted, with a sliding manner, into each one of said respective heddle frames arranged correspondingly to each one of said heddle frame designating sections, with the dummy yarn being inserted through said heddle eyes of said respective heddles, each one of said end portions of a plurality of a first yarn ends group of said dummy-yarns, which are gripped by said first dummy-yarn holding, means are connected to a predetermined winding means on a weaving machine.

11. An automatic heddling apparatus according to claim 1 or 2, wherein, said apparatus is configured so that each one of the operations such as of carrying either one of the heddles and the dummy yarns, of cutting the dummy yarns, or the like, is automatically carried out.

12. An automatic heddling apparatus according to claim 1 or 2, comprising a plurality of leasing mechanisms used at least for leasing ground yarns, selvage yarns, binding yarns or the like.

13. An automatic heddling apparatus according to claim 1 or 2, wherein, a plurality of said heddle frame designating sections in each one of which at least one heddle is stacked therein, respectively, are provided at each one of predetermined positions inside of said heddle frame designating means and further wherein said apparatus is provided with a mechanism which keeps said heddle frame designating means at a predetermined separated portion apart from said apparatus, under a condition in that a predetermined number of heddles are stacked in the respective heddle frame designating sections, respectively, with the dummy yarn being inserted through said heddle eyes of said respective heddles.

14. An automatic heddling apparatus according to claim 3, said apparatus being further provided with a mechanism which moves each one of said heddles to one of said heddle frame designating sections of said heddle frame designating means and corresponding to a specific heddle frame designated in response to controlling information obtained by said weave construction chart for a desired fabric, and accumulates said heddles into said specified heddle frame designating section.

15. An automatic heddling apparatus according to claim 3, said apparatus being further provided with a mechanism which enables to move each one of said heddles by a heddle holding and conveying section whose holding and conveying operation are controlled in response to the control information obtained from the weave construction chart.

16. An automatic heddling apparatus according to claim 3, wherein, said apparatus being configured so that either one of said yarn gripping means, said first and second dummy-yarn holding members, said yarn clipping means and said yarn cutting means can perform either one of said yarn gripping operation, yarn holding operation, yarn clipping operation, yarn removing operation and yarn cutting operation, in response to the control information obtained from said weave construction chart.

17. An automatic heddling apparatus according to claim 1 or 2, said apparatus being further provided with a mechanism for fixing all end portions of said dummy yarns held at said first dummy-yarn holding member to a predetermined portion of a fabric winding roller when a certain number of said heddles out of all of said heddles are collected into said heddle collecting and holding means, and corresponding to the number of heddles designated by a fabric information storage means, had been delivered into each one of said respective heddle frame designating sections in said heddle frame designating means and an automatic yarn tying means for sequentially connecting each one of said end portions of said overall dummy yarns held at said second dummy yarn holding member to corresponding each one of said end portions of the respective warp yarns forming a group to which a warping treatment had already been completed, starting from the outer most end dummy yarn and warp yarn in one side thereof to the outer most end dummy yarn and warp yarn in an opposite side thereof.

18. An automatic heddling apparatus comprising:

a heddle integrating and holding means for integrating and holding therein a plurality of heddles taken out from a predetermined number of heddle frames;

a dummy-yarn insertion means for passing one dummy yarn commonly through a plurality of heddle eyes each being provided respectively on the plurality of heddles held in said heddle integrating and holding means;

a heddle frame designating means comprising a plurality of heddle frame designating sections each being able to hold one or a plurality of said heddles therein and disposed at the respective positions corresponding to positions at which one or a plurality of said heddle frames being arranged;

a yarn clipper means which having a function to grip or release the dummy yarn and also having a configuration so as to move from a position in the vicinity of a place at which said heddle integrating and holding means locating, to a predetermined position located at a position opposite to said heddle frame designating means beyond said heddle frame designating means so that said dummy yarn being extended between said predetermined position and said heddle integrating and holding means and to return back to said position in the vicinity of a place at which said heddle integrating and holding means locating, with a predetermined timing, after when said dummy yarn had been extended therebetween;

a heddle gripping and conveying section for taking out one predetermined heddle among said plurality of said heddles from said heddle integrating and holding means and moving said picked up heddle along said extended dummy yarn so as to stack said heddle in a predetermined one of said heddle frame designating sections provided inside said heddle frame designating means;

a first dummy-yarn holding member provided between the said heddle integrating and holding means and said heddle frame designating means;

a second dummy yarn holding member provided at a position opposite to the position at which said first dummy-yarn holding member being provided, with respect to said heddle frame designating means; and dummy-yarn engaging means for performing operations to engage an end portions or a part of said end portions of each one of said dummy yarns with either one of a first and a second dummy-yarn holding members.

19. An automatic heddling apparatus according to claim 18, wherein said apparatus being further provided with at least one leasing means between said heddle frame designating section and said second dummy-yarn holding member.

20. An automatic heddling apparatus according to claim 18 or 19, wherein said apparatus being further provided between said heddle integrating and holding means and said first dummy-yarn holding member, with a yarn cutter for cutting said dummy-yarn extended over therebetween.

21. An automatic heddling apparatus according to claim 18 or 19, wherein said apparatus being further provided with a heddle insertion means for inserting one heddle as being stacked into the respective heddle frame designating sections in said heddle frame designating means into one of the heddle frames each being arranged opposite to each one of said heddle frame designating sections, with a sliding manner, respectively, while under a condition in that each one of said heddles being engaged with said dummy yarn.

22. Automatic heddling according to claim 18 or 19, wherein said apparatus being further provided with an automatic control means which enabling to control each one of said operations of each of said means, respectively, utilizing a predetermined program.

23. An automatic heddling apparatus according to claim 22, wherein said automatic control means being configured so as to be driven with control information obtained from a weave construction chart representing the weave construction of a desired fabric.

24. An automatic heddling apparatus according to claim 18 or 19, wherein said apparatus being further provided with a heddle storing means which enabling to store therein a plurality of said heddle frames each of which having being oppositely arranged to each one of said heddle frame designating sections, respectively, and into each of which, one or a plurality of said heddles stacked and held in the respective heddle frame designating sections of said heddle frame designating means being inserted with a sliding manner and to store a plurality of said dummy yarns being passed through each one of said heddles, as they are.

25. A method for automatic heddling, said method comprising the steps of:

removing a plurality of heddles from a plurality of heddle frames;

integrally collecting a plurality of said heddles thus removed from said heddle frames in such a manner that flat faces of the heddles may face opposite to each other and storing the heddles as collected in predetermined heddle integrating and holding means;

passing one dummy yarn simultaneously through all of heddle eyes provided on each one of said heddles, as collected, respectively;

holding one end of said dummy yarn passing commonly through all of said heddle eyes of each one of said plurality of heddles, at a first dummy-yarn holding member;

causing a movable yarn clipping means to grip said end of said dummy yarn engaged at said dummy-yarn holding member and simultaneously with this, causing said dummy-yarn holding member to release the engagement of said dummy yarn;

causing said yarn clipper means to move to a position at which said dummy yarn is to be engaged with a second dummy-yarn holding member, beyond each one of heddle frame designating sections each corresponding to the respective heddles, while said yarn clipping means is gripping said end portion of said dummy yarn;

causing said yarn clipper means to engage an end portion of said dummy yarn after the dummy yarn with a second dummy yarn holding member and thereafter, causing said yarn clipper means to release the engagement of said end portion of said dummy yarn;

causing a heddle gripping and conveying section to grip a first heddle arranged at the most end position among a plurality of said stacked heddles which being collected inside of said heddle integrating and holding means and causing said heddle gripping and conveying section to transfer said heddle thus gripped thereby to one of said heddle frame designating sections each being provided within said heddle frame designating means, with a sliding manner along said dummy yarn extended between said heddle integrating and holding means and said second dummy yarn holding member so as to deliver said heddle to a desired heddle frame designating section;

engaging said dummy yarn extended between said heddle frame designating means and said yarn gripping means with said first dummy yarn holding member provided between said heddle frame designating means and said yarn gripping means extended over between the heddle frame designating block and the yarn gripping section to the first dummy-yarn holding member, after said respective heddle had been delivered into specifically designated heddle frame designating section;

causing said yarn gripping means to grip said dummy yarn again;

causing a yarn cutter to cut said dummy yarn extended between said first dummy-yarn holding member and said yarn gripping means;

returning said yarn clipper means from a position in the vicinity of said second dummy-yarn holding member to a position in the vicinity of said first dummy-yarn holding member and to grip again an end portion of said dummy yarn engaged with said yarn gripping means; and repeating the above-mentioned steps starting from the first step.

26. A program for causing a computer to execute an automatic heddling method, the method comprising the steps of:

removing a plurality of heddles from a plurality of heddle frames;

integrally collecting a plurality of said heddles thus removed from said heddle frames in such a manner that flat faces of the heddles may face opposite to each other and storing the heddles as collected in predetermined heddle integrating and holding means;

passing one dummy yarn simultaneously through all of heddle eyes provided on each one of said heddles, as collected, respectively;

holding one end of said dummy yarn passing commonly through all of said heddle eyes of each one of said plurality of heddles, at a first dummy-yarn holding member;

causing a movable yarn clipping means to grip said end of said dummy yarn engaged at said dummy-yarn holding member and simultaneously with this, causing said dummy-yarn holding member to release the engagement of said dummy yarn;

causing said yarn clipper means to move to a position at which said dummy yarn is to be engaged with a second dummy-yarn holding member, beyond each one of heddle frame designating sections each corresponding to the respective heddles, while said yarn clipping means is gripping said end portion of said dummy yarn;

causing said yarn clipper means to engage an end portion of said dummy yarn after the dummy yarn with a second dummy yarn holding member and thereafter, causing said yarn clipper means to release the engagement of said end portion of said dummy yarn;

causing a heddle gripping and conveying section to grip a first heddle arranged at the most end position among a plurality of said stacked heddles which being collected inside of said heddle integrating and holding means and causing said heddle gripping and conveying section to transfer said heddle thus gripped thereby to one of said heddle frame designating sections each being provided within said heddle frame designating means, with a sliding manner along said dummy yarn extended between said heddle integrating and holding means and said second dummy yarn holding member so as to deliver said heddle to a desired heddle frame designating section;

engaging said dummy yarn extended between said heddle frame designating means and said yarn gripping means with said first dummy yarn holding member provided between said heddle frame designating means and said yarn gripping means extended over between the heddle frame designating block and the yarn gripping section to the first dummy-yarn holding member, after said respective heddle had been delivered into specifically designated heddle frame designating section;

causing said yarn gripping means to grip said dummy yarn again;

causing a yarn cutter to cut said dummy yarn extended between said first dummy-yarn holding member and said yarn gripping means;

returning said yarn clipper means from a position in the vicinity of said second dummy-yarn holding member to a position in the vicinity of said first dummy-yarn holding member and to grip again an end portion of said dummy yarn engaged with said yarn gripping means; and repeating the above-mentioned steps starting from the first step.

* * * * *

UNITED STATES PATENT AND TRADEMARK OFFICE

CERTIFICATE OF CORRECTION

PATENT NO. : 6,901,970 B2
DATED : June 7, 2005
INVENTOR(S) : Koichi Kikuchi

It is certified that error appears in the above-identified patent and that said Letters Patent is hereby corrected as shown below:

Column 20,
Line 37, delete “claim 1 or 5” and insert -- claim 5 --.
Line 41, delete “, is” and insert -- is --.

Signed and Sealed this

Twenty-second Day of November, 2005

JON W. DUDAS
*Director of the United States Patent and Trademark Office*